US006626743B1

(12) United States Patent
Boyd

(10) Patent No.: US 6,626,743 B1
(45) Date of Patent: Sep. 30, 2003

(54) METHOD AND APPARATUS FOR CONDITIONING A POLISHING PAD

(75) Inventor: John M. Boyd, Atascadero, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 09/540,602

(22) Filed: Mar. 31, 2000

(51) Int. Cl.[7] ..... B24B 1/00

(52) U.S. Cl. ..... 451/56; 451/285; 451/299; 51/138

(58) Field of Search ..... 451/41, 56, 276, 451/296, 299, 285, 287, 288; 51/135 R, 138, 273

(56) References Cited

U.S. PATENT DOCUMENTS

| | | | | |
|---|---|---|---|---|
| 3,753,269 A | | 8/1973 | Budman | |
| 3,812,622 A | * | 5/1974 | Parsons | 51/5 |
| 3,872,627 A | * | 3/1975 | Schuster | 451/296 |
| 4,318,250 A | | 3/1982 | Klievoneit et al. | |
| 4,672,985 A | | 6/1987 | Mohr | |
| 4,720,939 A | | 1/1988 | Simpson et al. | |
| 4,934,102 A | | 6/1990 | Leach et al. | |
| 5,081,051 A | | 1/1992 | Mattingly et al. | |
| 5,335,453 A | | 8/1994 | Baldy et al. | |
| 5,377,916 A | * | 1/1995 | Anderson | 451/296 X |
| 5,484,323 A | | 1/1996 | Smith | |
| 5,531,635 A | | 7/1996 | Mogi et al. | |
| 5,536,202 A | | 7/1996 | Appel et al. | |
| 5,547,417 A | | 8/1996 | Breivogel et al. | |
| 5,558,568 A | | 9/1996 | Talieh et al. | |
| 5,575,707 A | | 11/1996 | Talieh et al. | |
| 5,593,344 A | | 1/1997 | Weldon et al. | |
| 5,611,943 A | | 3/1997 | Cadien et al. | |
| 5,622,526 A | | 4/1997 | Phillips | |
| 5,643,044 A | | 7/1997 | Lund | |
| 5,655,951 A | | 8/1997 | Meikle et al. | |
| 5,692,947 A | | 12/1997 | Talieh et al. | |
| 5,692,950 A | | 12/1997 | Rutherford et al. | |
| 5,722,877 A | * | 3/1998 | Meyer et al. | 451/41 |
| 5,725,417 A | * | 3/1998 | Robinson | 451/287 X |
| 5,759,918 A | | 6/1998 | Hoshizaki et al. | |
| 5,762,536 A | * | 6/1998 | Pant et al. | 451/303 X |
| 5,779,526 A | | 7/1998 | Gill | |
| 5,871,390 A | | 2/1999 | Pant et al. | |
| 5,897,426 A | | 4/1999 | Somekh | |
| 5,899,798 A | | 5/1999 | Trojan et al. | |
| 5,908,530 A | | 6/1999 | Hoshizaki et al. | |
| 5,958,794 A | | 9/1999 | Bruxvoort et al. | |
| 5,961,372 A | * | 10/1999 | Shendon | 451/56 X |
| 6,086,460 A | | 7/2000 | Labunsky et al. | |
| 6,244,944 B1 | * | 6/2001 | Elledge | 451/296 |

FOREIGN PATENT DOCUMENTS

| | | |
|---|---|---|
| WO | WO 98/45090 | 10/1998 |
| WO | WO 99/22908 | 5/1999 |

OTHER PUBLICATIONS

S. Inaba, T. Katsuyama, M. Tanaka, "Study of CMP Polishing pad Control Method," 1998 CMP–MIC Conference, Feb. 19–20, 1998, 1998 IMIC—300P/98/0444.

U.S. patent application Ser. No. 09/475,518: "Method and Apparatus for Conditioning a Polishing Pad"; Inventor: Finkelman; Filed: Dec. 30, 1999.

(List continued on next page.)

*Primary Examiner*—Joseph J. Hail, III
*Assistant Examiner*—Anthony Ojini
(74) *Attorney, Agent, or Firm*—Brinks Hofer Gilson & Lione

(57) ABSTRACT

A method and apparatus for conditioning a polishing pad is described. The method includes applying a stream of pressurized liquid to the polishing pad, and removing a significant amount of slurry and liquid from the polishing pad using a vacuum. The apparatus includes a liquid distribution unit forming at least one opening upon which liquid is forced through at high pressure, the opening directed at the polishing pad, and a liquid recovery unit positioned downstream from the liquid distribution unit and in communication with the polishing pad, the liquid recovery unit connected with a vacuum for removing liquid and slurry from the polishing pad.

10 Claims, 7 Drawing Sheets

OTHER PUBLICATIONS

U.S. patent application Ser. No. 09/540,385: "Method and Apparatus for Chemically–Mechanically Polishing Semiconductor Wafers"; Inventors; Travis et al.; Filed Mar. 31, 2000.

U.S. patent application Ser. No. 09/540,810: "Fixed Abrasive Linear Polishing Belt and System"; Inventors: Zhao et al.; Filed Mar. 31, 2000.

U.S. patent application Ser. No. 09/541,144: "Method and Apparatus for Chemical Mechanical Planarization and Polishing of Semiconductor Wafers Using a Continuous Polishing Member Feed"; Inventors: Mooring et al.; Filed Mar. 31, 2000.

U.S. patent application Ser. No. Pending: A Conditioning Mechanism in a Chemical Mechanical Polishing Apparatus for Semiconductor Wafers; Inventors: Vogtmann et al.; Filed Jun. 30, 2000.

U.S. patent application Ser. No. 09/608,522: "Apparatus and Method for Qualifying a Chemical Mechanical Planarization Process"; Inventors: Boyd et al.; Filed Jun. 30, 2000.

U.S. patent application Ser. No. Pending: "Apparatus and Method for Conditioning a Fixed Abrasive Polishing Pad in a Chemical Mechanical Planarization Process"; Inventors: Ravkin et al.; Filed Jun. 30, 2000.

* cited by examiner 23
20
54
55
56
80
30
24
26, 28

METHOD AND APPARATUS FOR CONDITIONING A POLISHING PAD

FIELD OF THE INVENTION

The present invention relates to a method and apparatus for conditioning a polishing pad. More particularly, the present invention relates to a method and apparatus for conditioning a polishing pad used in the chemical mechanical planarization of semiconductor wafers.

BACKGROUND

Semiconductor wafers are typically fabricated with multiple copies of a desired integrated circuit design that will later be separated and made into individual chips. A common technique for forming the circuitry on a semiconductor is photolithography. Part of the photolithography process requires that a special camera focus on the wafer to project an image of the circuit on the wafer. The ability of the camera to focus on the surface of the wafer is often adversely affected by inconsistencies or unevenness in the wafer surface. This sensitivity is accentuated with the current drive toward smaller, more highly integrated circuit designs. Semiconductor wafers are also commonly constructed in layers, where a portion of a circuit is created on a first level and conductive vias are made to connect up to the next level of the circuit. After each layer of the circuit is etched on the wafer, an oxide layer is put down allowing the vias to pass through but covering the rest of the previous circuit level. Each layer of the circuit can create or add unevenness to the wafer that is preferably smoothed out before generating the next circuit layer.

Chemical mechanical planarization (CMP) techniques are used to planarize the raw wafer and each layer of material added thereafter. Available CMP systems, commonly called wafer polishers, often use a rotating wafer holder that brings the wafer into contact with a polishing pad moving in the plane of the wafer surface to be planarized. A polishing fluid, such as a chemical polishing agent or slurry containing microabrasives, is applied to the polishing pad to polish the wafer. The wafer holder then presses the wafer against the rotating polishing pad and is rotated to polish and planarize the wafer.

With use, the polishing pads used on the wafer polishers become clogged with used slurry and debris from the polishing process. The accumulation of debris reduces the surface roughness and adversely affects polishing rate and uniformity. Polishing pads are typically conditioned to roughen the pad surface, provide microchannels for slurry transport, and remove debris or byproducts generated during the CMP process.

One present method for conditioning a polishing pad uses a rotary disk embedded with diamond particles to roughen the surface of the polishing pad. Typically, the disk is brought against the polishing pad and rotated about an axis perpendicular to the polishing pad while the polishing pad is rotated. The diamond-coated disks produce predetermined microgrooves on the surface of the polishing pad. Because the linear velocities of the leading, center and lagging portions of the disk are different, the rate of microgrooving is different. This non-uniform microgrooving has led some pad conditioner manufacturers to add a continuous oscillation motion to the rotational movement of the rotary disk pad conditioners. This extra movement can result in part of the wafer being exposed to freshly conditioned portions of the polishing pad and another part of the wafer being exposed to a used portion of the pad.

Another apparatus and method used for conditioning a pad implements a rotatable bar on the end of an arm. The bar may have diamond grit embedded in it or high pressure nozzles disposed along its length. In operation, the arm swings the bar out over the rotating polishing pad and the bar is rotated about an axis perpendicular to the polishing pad in order to score the polishing pad, or spray pressurized water on the polishing pad, in a concentric pattern. These types of pad conditioners often do not provide uniform pad conditioning because they are only applied to a small portion of the width of the pad's surface at any given time. Thus, the pressure of the conditioner against the pad can vary.

SUMMARY

According to a first aspect of the present invention, a pad conditioning apparatus is provided having a liquid distribution unit having at least one opening upon which liquid is forced through at high pressure, the opening is positioned facing the polishing pad, and a liquid recovery unit is provided for retrieving liquid and debris. The liquid recovery unit is positioned downstream from the liquid distribution unit and has at least one opening connected with a vacuum. Also a housing is provided, wherein the housing forms a liquid chamber disposed around the opening of the liquid distribution unit and a vacuum chamber disposed around the opening of the liquid recovery unit. The vacuum chamber is in communication with the liquid chamber. In one embodiment, a seal is disposed along a length of a bottom surface of the housing, wherein the seal is located between the housing and the polishing pad.

According to another aspect of the present invention, a method of conditioning a polishing pad includes the steps of applying a stream of pressurized liquid to the polishing pad, and removing a significant amount of slurry and liquid from the polishing pad using a vacuum. In one embodiment, the method further comprises removing at least a portion of the slurry from the polishing pad using a vacuum, before the applying of a stream of pressurized liquid, and running the removed slurry through a slurry reclaim system in order to remove impurities from the slurry.

Figure 1:
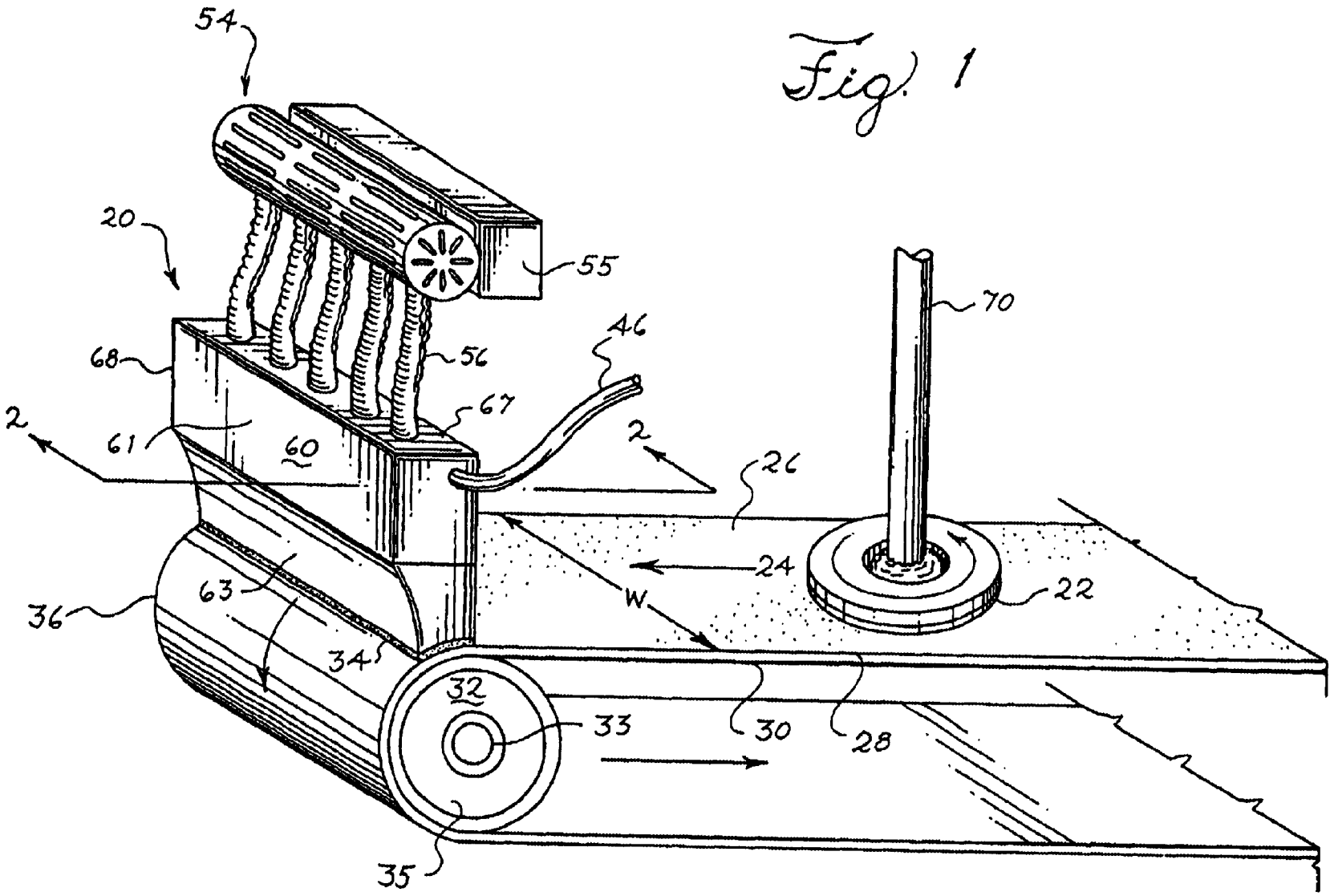
FIG. 1 is a perspective view of a preferred embodiment of a pad conditioning apparatus.

It should be appreciated that for simplicity and clarity of illustration, elements shown in the Figures have not necessarily been drawn to scale. For example, the dimensions of some of the elements are exaggerated relative to each other for clarity. Further, where considered appropriate, reference numerals have been repeated among the Figures to indicate corresponding elements.

DETAILED DESCRIPTION OF THE PRESENTLY PREFERRED EMBODIMENTS

Figure 2:
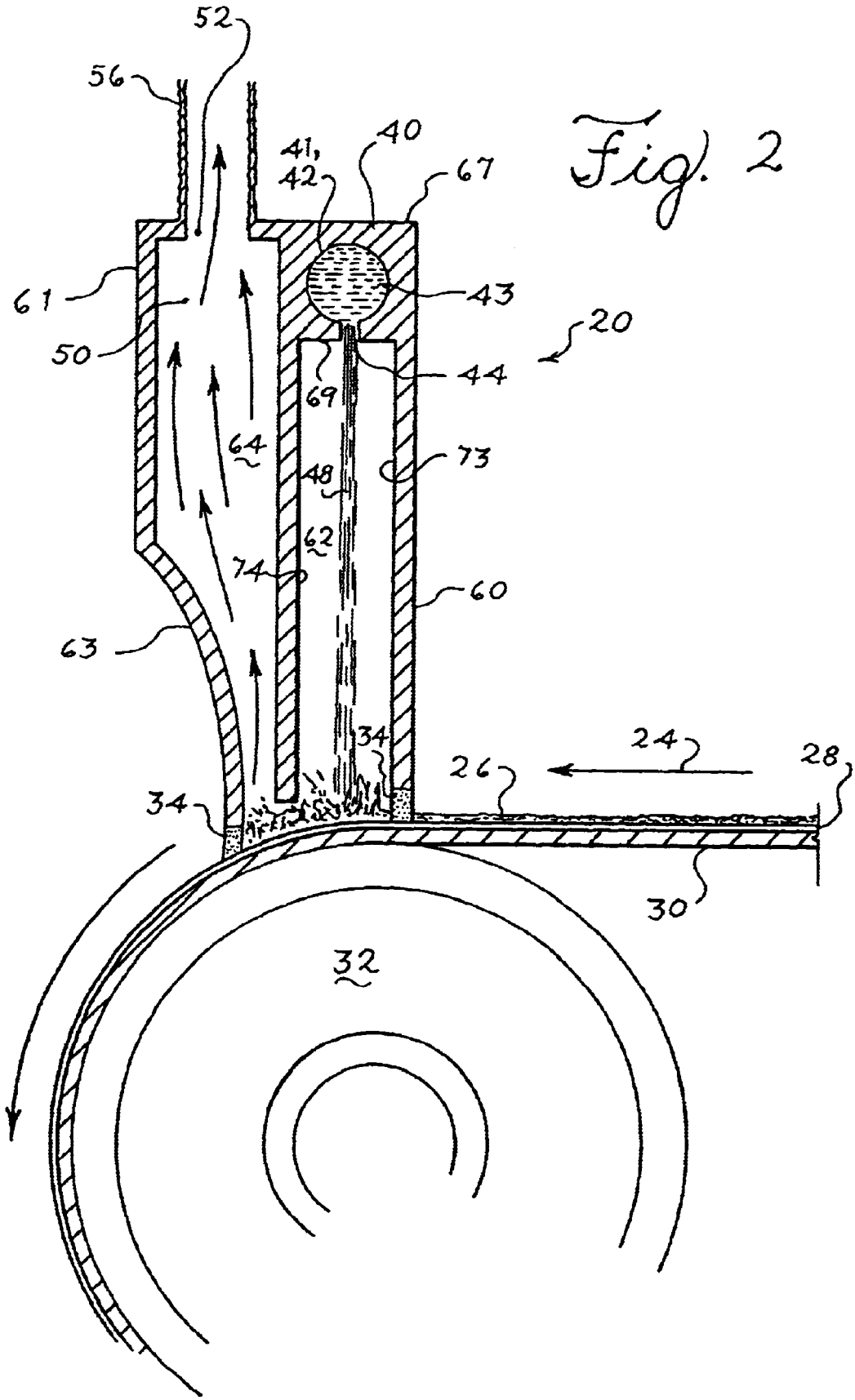
FIG. 2 is an enlarged cross-sectional side view of the pad conditioning apparatus of FIG. 1.
Figure 4:
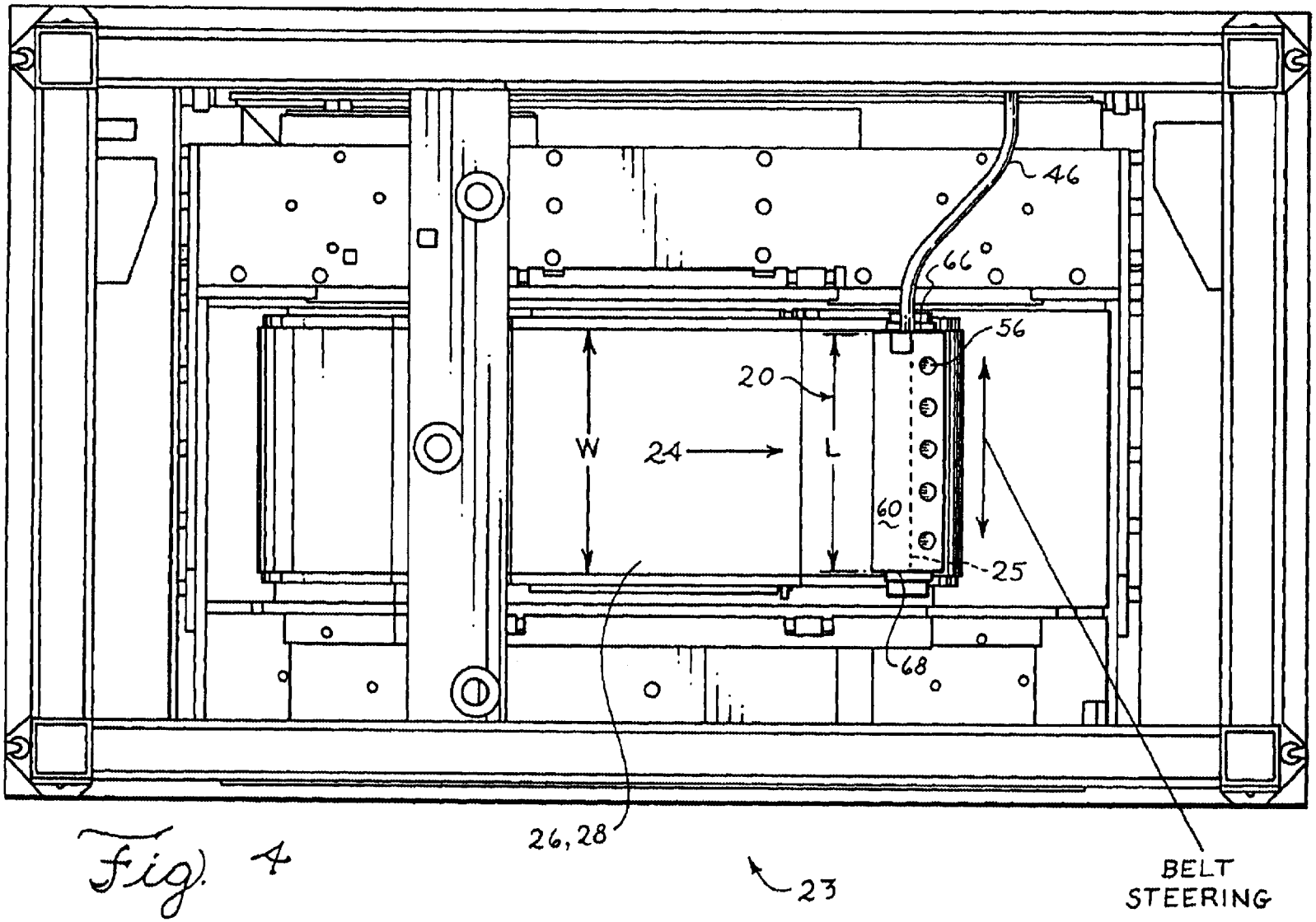
FIG. 4 is a top view of the polishing pad conditioner and linear belt polishing device of FIG. 4.
Figure 7:
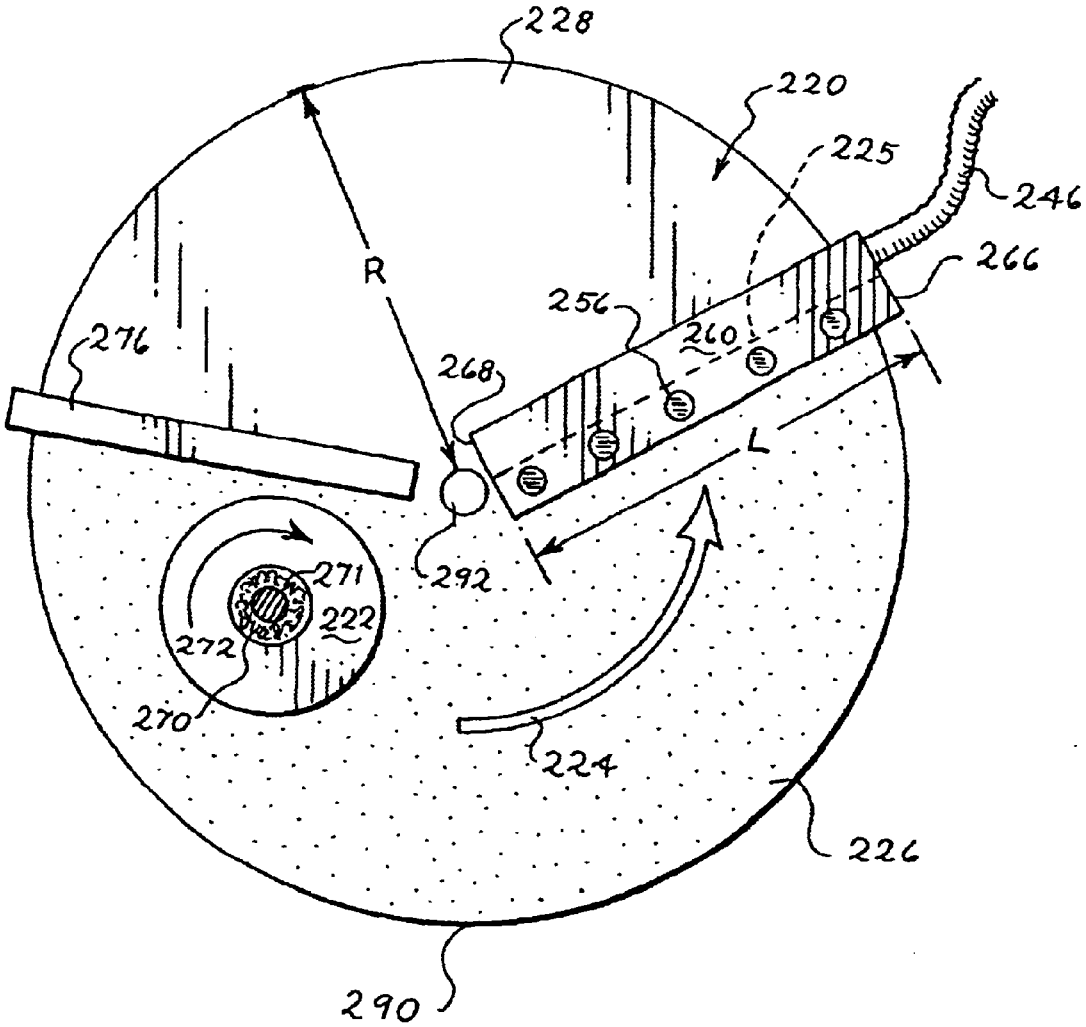
FIG. 7 is an alternative embodiment of the polishing pad conditioner used with a radial belt polishing device.

FIGS. 1 and 2 illustrate a presently preferred embodiment of pad conditioner 20 according to the present invention. Pad conditioner 20 is used to condition polishing pad 28, preferably for use in chemical mechanical planarization of semiconductor wafers 22. Pad conditioner 20 includes liquid distribution unit 40, liquid recovery unit 50, and housing 60. Preferably, pad conditioner 20 is disposed along the width W or radius R of polishing pad 28, as illustrated in FIGS. 4 and 7. Pad conditioner 20 has a length L defined as the distance between first end 66 and second end 68, as illustrated in FIGS. 4 and 7. Preferably, pad conditioner 20 has a length L that is equal to a substantial amount of or greater than the width W or radius R of polishing pad 28 to allow pad conditioner 20 to condition the all or a substantial amount of the surface of polishing pad 28. By positioning pad conditioner 20 along the width W or radius R of polishing pad 28, and by giving pad conditioner 20 a length L, pad conditioner 20 is able to provide uniform pad conditioning since pad conditioner 20 conditions a substantial portion of the width W of the surface of polishing pad 28 at any given time. In one preferred embodiment, pad conditioner 20 has a length L that is less than the width W of polishing pad 28. Pad conditioner 20 includes a longitudinal axis 25 that extends from and is generally perpendicular to first end 66 to second end 68, as shown in FIG. 4. Preferably, longitudinal axis 25 is aligned in a direction generally perpendicular to forward direction 24 of polishing pad 46, as illustrated in FIGS. 4 and 7. While pad conditioner 20 forms a generally rectangular footprint over polishing pad 28, as illustrated in FIGS. 1 and 4, as known by one of ordinary skill in the art, pad conditioner 20 can form footprints with a variety of shapes such as a v-shape, a w-shape, a u-shape, and any other irregularly shaped footprint over polishing pad 28.

Liquid distribution unit 40 is positioned upstream from liquid recover unit 50 and applies a high pressure stream of liquid 48 on polishing pad 28, as illustrated in FIG. 2. Preferably, high pressure stream 48 extends across a substantial amount of the width W or radius R of polishing pad 28, in order to clean all or a substantial amount of slurry 26 from polishing pad 28. Liquid distribution unit 40 includes liquid container 41 and forms at least one opening 44 upon which liquid is forced through at a relatively high pressure of about 15 PSIg ("gauge pressure in pounds per square inch") to about 100 PSIg. The opening 44 can be positioned very close to the pad 28 to minimize the length of the high pressure stream 48. Liquid container 41 stores an amount of liquid before the liquid is actually forced out of opening 44. Preferably, liquid container 41 is maintained at a pressure of about 15 PSIg to about 100 PSIg. In one preferred embodiment, liquid container 41 comprises a pipe 42, as illustrated in FIG. 2. Opening 44 is positioned such that the liquid 43 which is forced out of opening 44 comes into contact with polishing pad 28. Preferably, liquid 43 forms high pressure stream 48 of liquid 43. By forcing liquid 43 through opening 44 at high pressure and into contact with polishing pad 28, liquid distribution unit 40 is able loosen slurry 26 from polishing pad 28. High pressure stream 48 helps in removing slurry 26 from polishing pad 28. In one preferred embodiment, liquid container 41 is in connection with liquid hose 46. Liquid hose 46 supplies liquid 43 to liquid container 41, preferably at high pressure. Liquid hose 46 may be comprised of any suitable material such as rubber. Liquid 43 stored in liquid container 41 and supplied through liquid hose 46 can comprise any liquid that can be applied to a surface at high pressure. In one preferred embodiment, liquid 43 stored in liquid container 41 and supplied through liquid hose 46 comprises a liquid selected from the group consisting of water, potassium hydroxide, ammonium hydroxide, combinations of the above with hydrogen peroxide, combinations of the above with chelating agents such as EDTA, citric acid.

In one preferred embodiment, liquid distribution unit 40 forms a series of small openings 44 upon which liquid 43 is forced through at a relatively high pressure. Liquid 43 is forced through the small openings 44 to form a high pressure stream of liquid 48 having a fan-like shape. Preferably, small openings 44 span at least 50% of the width of polishing pad 28. In one preferred embodiment, small openings 44 span substantially all the width of polishing pad 28. In another preferred embodiment, liquid distribution unit 40 forms a series of small slits in which liquid 43 is forced through at relatively high pressure. In one preferred embodiment, liquid distribution unit 40 forms at least one long slit, spanning substantially all the width W or radius R of polishing pad 28, in which liquid 43 is forced through at relatively high pressure. Further, it will be recognized by those skilled in the art that liquid distribution unit 40 may form a variety of openings 44 that can accomplish the task of spraying liquid 43 at high pressure against the surface of polishing pad 28, such as nozzles, a water jet array, or a water knife.

Figure 3:
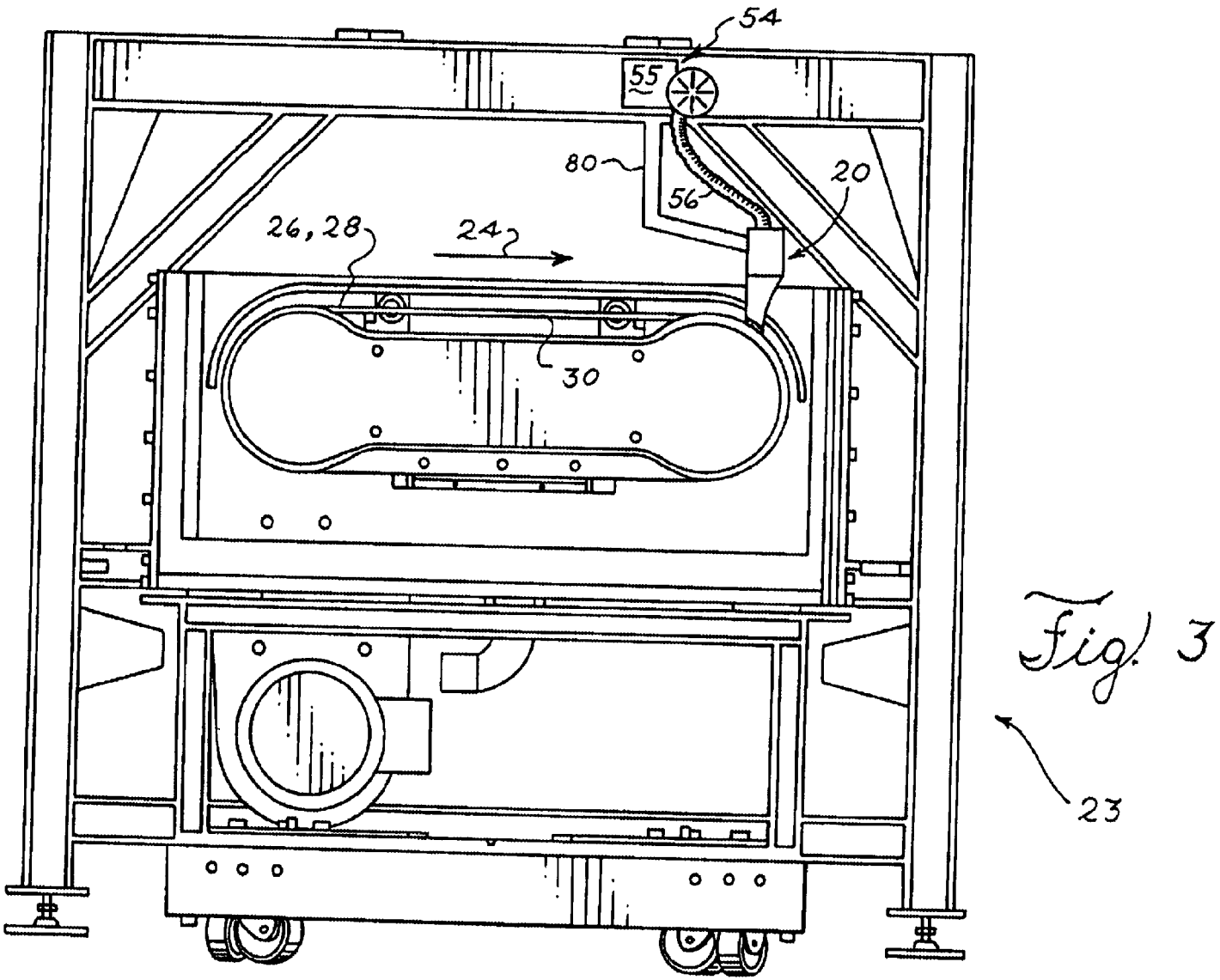
FIG. 3 is a side view of the pad conditioner of FIG. 1 used with a linear belt polishing device.

Once the slurry has been loosened by high pressure stream 48, the slurry 26 and liquid 43 from high pressure stream 48 must be removed from polishing pad 28. There are many methods known to one of ordinary skill in the art for removing liquid 43 and slurry 26 from polishing pad 28, such as using a rubber squeegee or using a high pressure stream of air. Preferably, liquid 43 and slurry 26 are removed from polishing pad 28 using a vacuum of air, such as that used by liquid recovery unit 50. Liquid recovery unit 50 is positioned downstream from liquid distribution unit 40, as illustrated in FIG. 2. Liquid recovery unit 50 is designed to retrieve liquid 43 and debris, such as slurry 26, from the surface of polishing pad 28. In one preferred embodiment, liquid recovery unit 50 is positioned adjacent liquid distribution unit 40. By positioning liquid recovery unit 50 adjacent liquid distribution unit 40, liquid recovery unit 50 can immediately retrieve liquid 43 and debris before the liquid 43 and debris have time to re-lodge themselves back into polishing pad 28. Liquid recovery unit 50 forms at least one opening 52. Opening 52 is connected to vacuum 54 through a vacuum hose 56, as illustrated in FIG. 4. Vacuum 54 creates a vacuum of air, pulling liquid 43 and debris from the surface of polishing pad 28 and into a containment unit 55 either for possible reclamation of slurry 26 or for disposal of the liquid and debris, as illustrated in FIG. 3. In one preferred embodiment, vacuum 54 applies a suction force of about−3 PSIg to about−10 PSIg to polishing pad 28 in order to remove a substantial amount of liquid 43 and debris from the surface of polishing pad 28. Preferably, pad conditioner 20 includes housing 60. Housing 60 protects liquid distribution unit 40 and liquid recovery unit 50. In one preferred embodiment, housing 60 is located near or comes into close contact with polishing pad 28, as illustrated in FIGS. 1–2, in order to prevent materials within housing 60, such as liquid and slurry 26, from contaminating the area surrounding housing 60. Housing 60 may be manufactured from any suitable material, such as stainless steel or hardened plastic. Housing 60 has a containment portion 61 connected to a curved portion 63, and first and second ends 66, 68. Containment portion 61 is designed to house and protect at least one of liquid distribution unit 40 and liquid recovery unit 50. Curved portion 63 is disposed around the opening 52 of liquid recovery unit 50 in order to increase the amount of suction by the vacuum at the surface of polishing pad 28, as illustrated in FIG. 2. By increasing the amount of suction at the surface of polishing pad 28, the amount of liquid and slurry 26 pulled from the surface of polishing pad 28 is increased. First end 66 is opposed to second end 68 wherein the distance between first end 66 and second end 68 is preferably equal to or greater than the width W or radius R of polishing pad 28, in order to maximize the amount of the surface cleaned on polishing pad 28, as illustrated in FIGS. 4 and 7. Preferably, first end 66 and second end 68 extend from top portion of housing 60 to the surface of polishing pad 28 in order to form a seal between housing 60 and polishing pad 28 and in order to prevent liquid and slurry 26 from covering the area surrounding wafer polisher 23.

In one preferred embodiment, housing 60 forms liquid chamber 62 disposed around opening 44 and a vacuum chamber 64 disposed around opening 52, wherein vacuum chamber 64 is in communication with liquid chamber 62. Liquid chamber comprises a first wall 73 opposed to a second wall 74 and a ceiling 69 connecting first wall 73 to second wall 74. Preferably, first wall 73 and curved portion 63 come into contact with or are very near the surface of polishing pad 28. However, second wall 74, or at least a portion of second wall 74, preferably does not come into contact with the surface of polishing pad 28, thus allowing vacuum chamber 64 to be in communication with liquid chamber 62. By allowing vacuum chamber 64 to be in communication with liquid chamber 62, liquid and slurry 26 which has been loosened by high pressure stream 48 from polishing pad 28 can then enter vacuum chamber 64 and be removed from polishing pad 28 using a vacuum or other means. Vacuum chamber 64 comprises second wall 74 opposed to curved portion 63 and containment portion 61, as illustrated in FIG. 2. Containment portion 61 is connected to curved portion 63, as illustrated in FIG. 2. Second wall 74 is connected to containment portion 61 through top portion 67. Opening 52 is located in top portion 67 and provides a way for liquid and slurry 26 to exit from vacuum chamber 64.

In one preferred embodiment, a seal 34 is disposed between housing 60 and polishing pad 28, as illustrated in FIGS. 1–2. Seal 34 is designed to prevent materials within housing 60, such as liquid and slurry 26, from contaminating the area surrounding housing 60. Seal 34 may be comprised of any suitable material such a Delrin™, rubber, PEEK, or even nylon. Specifically, seal 34 is attached to the bottom of curved portion 63, first wall 73, first end 66 and second end 68. In one preferred embodiment, seal 34 comprises an abrasive substance, such as a diamond grit embedded in a strip affixed along the bottom edges of seal 34, between seal 34 and polishing pad 28. The diamond grit may have an average abrasive particle size of 1 to 70 $\mu$m, with densities ranging from 2% to 80%. Preferably, the diamond grit is dispersed randomly along the strip. The strip may have any desired width. In another embodiment, seal 34 comprises a brush disposed between the bottom of curved portion 63 and first wall 73, and the surface of polishing pad 28. The brush may be made of a commonly available material such as nylon. For simplicity, FIGS. 1 and 2 illustrate the embodiment of the pad conditioner 20 having just a seal 34 comprised of rubber and not having an abrasive substance or brush.

Figure 5:
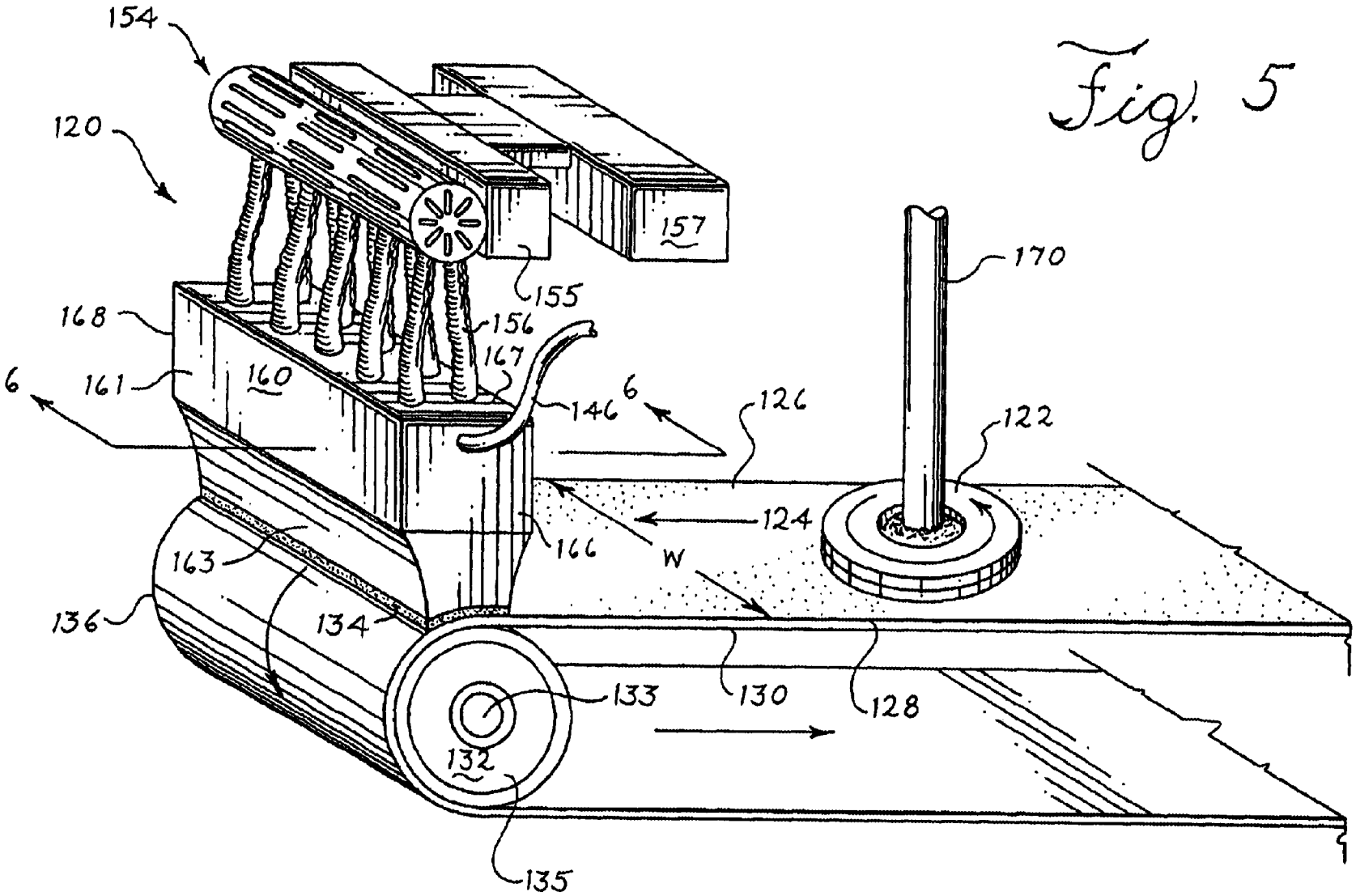
FIG. 5 is a perspective view of a preferred embodiment of a pad conditioning apparatus.
Figure 6:
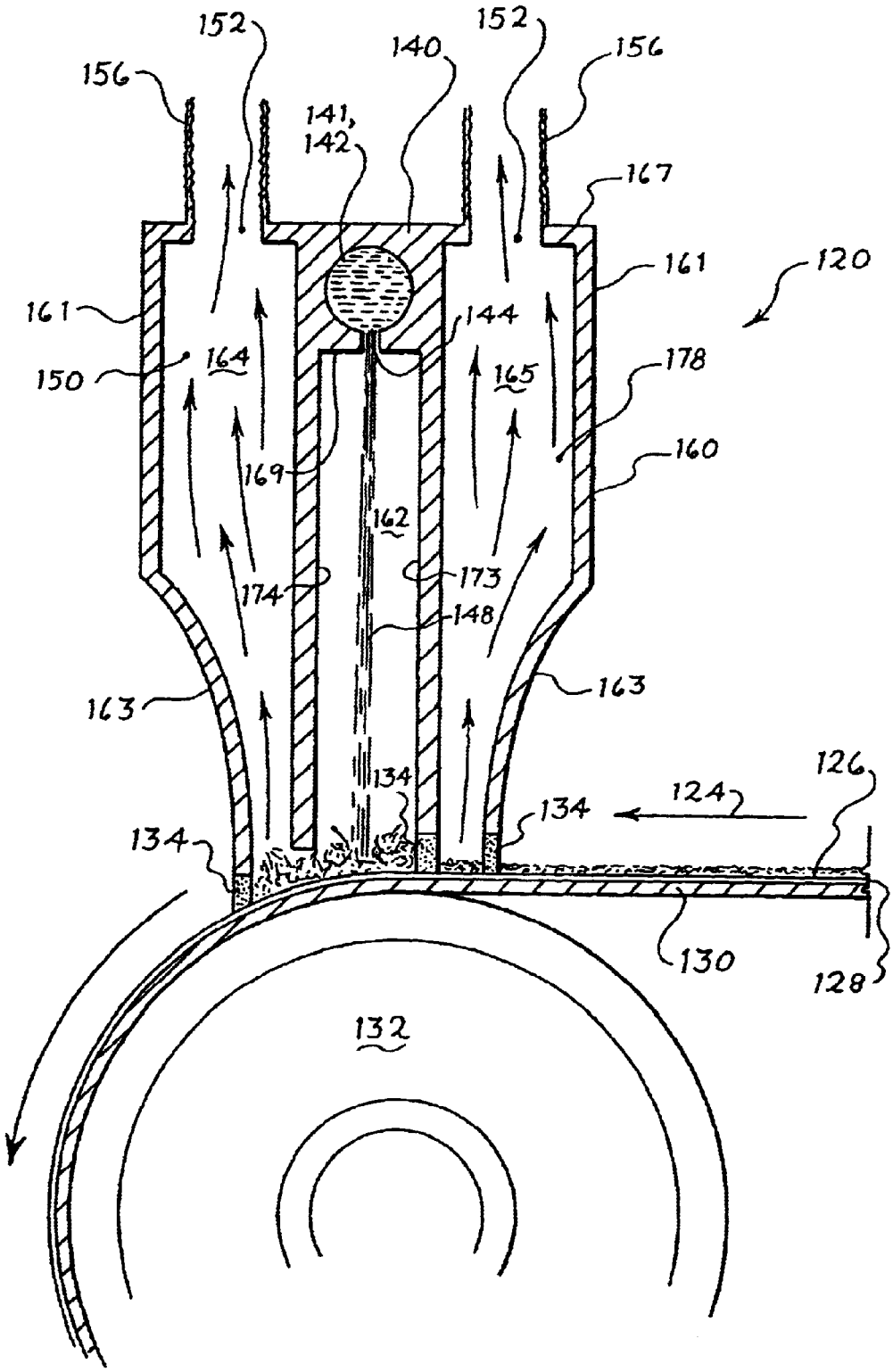
FIG. 6 is an enlarged cross-sectional side view of the pad conditioning apparatus of FIG. 5.

FIGS. 5 and 6 show an alternative embodiment of the pad conditioner 120. In the embodiment of FIGS. 5 and 6, the pad conditioner 120 includes a slurry recovery unit 178 designed to recover slurry 126 from the polishing pad 128. Slurry recovery unit 178 recovers any loose slurry 126 that is sitting on the surface of polishing pad 128, as illustrated in FIG. 6. There are many methods known to one of ordinary skill in the art for recovering slurry 126 from polishing pad 128. In one preferred embodiment, slurry 126 is removed by slurry recovery unit 178 from polishing pad 128 using a vacuum of air. Slurry recovery unit 178 is positioned upstream from liquid distribution unit 140, as illustrated in FIG. 6. Slurry recovery unit 178 is designed to retrieve debris, such as slurry 126, from the surface of polishing pad 128. In one preferred embodiment, slurry recovery unit 178 is positioned adjacent liquid distribution unit 140. By positioning slurry recovery unit 178 adjacent liquid distribution unit 140, liquid distribution unit can immediately clean the surface of polishing pad 128 before any debris, such as slurry 126, has time to re-lodge itself back into polishing pad 128. Slurry recovery unit 178 forms at least one opening 152. Opening 152 is connected to a vacuum 154 through a vacuum hose 156, as illustrated in FIGS. 5–6. The vacuum creates a vacuum of air, thus pulling slurry 126 and any debris from the surface of polishing pad 128 into a containment unit 155 for possible reclamation of slurry 126. Slurry 126 removed from polishing pad 128 can be run through a slurry reclaim system 157 in order to remove impurities from slurry 126 and allow slurry 126 to be reapplied onto polishing pad 128. In one preferred embodiment, housing 160 includes a curved portion 163 disposed around the opening 152 of slurry recovery unit 178 in order to increase the amount of suction by the vacuum at the surface of polishing pad 128, as illustrated in FIG. 6. By increasing the amount of suction at the surface of polishing pad 128, the amount of slurry 126 pulled from the surface of polishing pad 128 is increased.

In one preferred embodiment, wafer polisher 23 is linear belt polisher having polishing pad 28 mounted on linear belt 30 that travels in one direction, as illustrated in FIGS. 1–4. In this embodiment, linear belt 30 is mounted on a series of rollers 32, as illustrated in FIGS. 2–3. Rollers 32 preferably include coaxially disposed shafts 33 extending through the length of rollers 32. Alternatively, each shaft 33 may be two separate coaxial segments extending partway in from each of the ends 35, 36 of rollers 32. In yet another embodiment, each shaft 33 may extend only partly into one of the ends 35, 36 of rollers 32. Connectors (not shown) on either end 35, 36 of rollers 32 hold each shaft 33. A motor (not shown) connects with at least one shaft 33 and causes rollers 32 to rotate, thus moving linear belt 30 and polishing pad 28. Preferably, polishing pad 28 is stretched and tensed when mounted on rollers 32, thus causing pores of on the surface of polishing pad 28 to open in order more easily loosen and remove slurry 26 from polishing pad 28. In one preferred embodiment, polishing pad 28 is stretched and tensed to a tension of approximately 1100 lbs. FIG. 3 illustrates one environment in which a preferred embodiment of pad conditioner 20 may operate. In FIG. 3, pad conditioner 20 is positioned on a support member 80 attached to a frame 43 of wafer polisher 23. The wafer polisher 23 may be a linear belt polisher such as the TERES™ polisher available from Lam Research Corporation of Fremont, Calif. The alignment of the pad conditioner 20 with respect to the polishing pad 28 is best shown in FIGS. 1, 3, and 4.

In one preferred embodiment, wafer polisher 223 is a radial polisher having polishing pad 228 mounted on circular disc 290 that rotates in one direction, as illustrated in FIG. 7. Circular disc 290 rotates about shaft 292 while semiconductor wafer 222 and wafer holder 270 rotate about shaft 271 located a distance away from shaft 292. Preferably, shaft 292 is positioned coaxially with shaft 271. A slurry applicator 276 applies slurry to polishing pad 228 as polishing pad 228 rotates about shaft 292. Pad conditioner 220 is mounted radially about polishing pad 228 by using a mount or a robotic arm (not shown). By positioning pad conditioner 220 radially about polishing pad 228, pad conditioner 220 is able to condition a substantial amount, if not all, of polishing pad 228, as illustrated in FIG. 7. In this embodiment, wafer polisher 223 may be a radial polisher such as the Mirra polisher available from Applied Materials of Santa Clara, Calif. The alignment of the pad conditioner 220 with respect to the polishing pad 228 is best shown in FIG. 7.

When wafer polisher 23 is activated, belt 30 beings to move in a forward direction 24, as illustrated in FIGS. 1, 2, and 4–7. As belt 30 moves, slurry 26 is applied using a slurry applicator, such as slurry applicator 276. Slurry 26 then moves across and polishes semiconductor wafer 22. Upon moving across semiconductor wafer 22, slurry 26 becomes contaminated with debris from the surface of semiconductor wafer 22. Slurry 26, contaminated with debris, then approaches pad conditioner 20. Liquid distribution unit 40, positioned upstream from liquid recovery unit 50, applies a high pressure stream of liquid 48 onto polishing pad 28 in order to loosen the slurry 26 and debris from polishing pad 28. Once slurry 26 and debris have been loosened by high pressure stream 48, slurry 26, debris, and the liquid from high pressure stream 48 are removed from polishing pad 28 using a vacuum (not shown). In one preferred embodiment, pad conditioner 20 includes slurry recovery unit 178, positioned upstream from the liquid distribution unit 150, in which case loose slurry 126 that is sitting on the surface of polishing pad 128 is recovered from polishing pad 128 before applying high pressure stream 48 to polishing pad 128. The loose slurry 126 then moved to a containment unit 155 for possible reclamation of slurry 126.

An advantage of the presently preferred pad conditioner 20 is that a substantial amount of slurry by-product can be removed from a polishing pad without using harsh abrasives that can either damage the polishing pad or cause excessive wear. Thus, the pad can retain an active work surface with reduced wear and reduced pad and slurry by-products. In another preferred embodiment, the pad conditioning process may also include the step of moving the polishing pad from side to side as illustrated by the arrow designated "belt steering" in FIG. 4.

Thus, there has been disclosed in accordance with the invention, a method and apparatus for conditioning a polishing pad that fully provides the advantages set forth above. Although the invention has been described and illustrated with reference to specific illustrative embodiments thereof, it is not intended that the invention be limited to those illustrative embodiments. Those skilled in the art will recognize that variations and modifications can be made without departing from the spirit of the invention. It is therefore intended to include within the invention all such variations and modifications that fall within the scope of the appended claims and equivalents thereof.

What is claimed is:

1. An apparatus for conditioning a polishing pad used in chemical mechanical planarization of semiconductor wafers, the polishing pad moving in a forward direction, the apparatus comprising:

a liquid distribution unit having at least one opening upon which liquid is forced through at high pressure, the opening positioned facing the polishing pad;

a liquid recovery unit for retrieving liquid and debris, the liquid recovery unit positioned downstream from the liquid distribution unit and having at least one opening connected with a vacuum; and a housing forming a liquid chamber disposed around the opening of the liquid distribution unit and a vacuum chamber disposed around the opening of the liquid recovery unit, wherein the vacuum chamber is in communication with the liquid chamber.

2. The apparatus of claim 1, wherein a bottom surface of the housing is in communication with the polishing pad.

3. The apparatus of claim 1, further comprising a seal disposed along a length of a bottom surface of the housing, the seal located between the housing and the polishing pad.

4. The apparatus of claim 1, further comprising an abrasive substance disposed along at least a portion of a bottom surface of the housing, the abrasive substance located between the housing and the polishing pad.

5. The apparatus of claim 1, wherein the polishing pad has a width, and the housing has a length that is at least equal to the width of the polishing pad.

6. The apparatus of claim 1, further comprising:

a slurry recovery unit for retrieving slurry, the slurry recovery unit positioned upstream from the liquid container and having at least one opening connected with a vacuum.

7. The apparatus of claim 6, wherein the housing forms a slurry chamber disposed around the opening of the slurry recovery unit.

8. The apparatus of claim 1, wherein the polishing pad is mounted upon a linear belt polisher.

9. The apparatus of claim 1, wherein the housing further comprises a containment portion surrounding the liquid distribution unit and the liquid recovery unit, and a curved portion disposed around the opening of the liquid recovery unit.

10. The apparatus of claim 1, wherein the polishing pad is mounted upon a circular disc.

* * * * *